US005951317A

United States Patent [19]

Tracy et al.

[11] Patent Number: 5,951,317

[45] Date of Patent: Sep. 14, 1999

[54] ACCESSORY CONNECTOR ASSEMBLY

[75] Inventors: James L. Tracy, Coral Springs; Stephen N. Koch, Plantation, both of Fla.

[73] Assignee: Motorola, Inc., Schaumburg, Ill.

[21] Appl. No.: 09/059,025

[22] Filed: Apr. 13, 1998

[51] Int. Cl.[6] ..... H01R 13/627

[52] U.S. Cl. ..... 439/352; 439/76.1

[58] Field of Search ..... 439/76.1, 352, 439/353, 493

[56] References Cited

U.S. PATENT DOCUMENTS

| | | | |
|---|---|---|---|
| 3,745,509 | 7/1973 | Woodward et al. | 439/493 |
| 5,041,022 | 8/1991 | Sekiguchi | 439/353 |
| 5,415,561 | 5/1995 | Marvin et al. | 439/353 |
| 5,545,052 | 8/1996 | Hirai | 439/354 |
| 5,609,499 | 3/1997 | Tan et al. | 439/493 |
| 5,756,695 | 5/1998 | Lane et al. | 439/76.1 |
| 5,806,152 | 9/1998 | Saitou et al. | 439/352 |

*Primary Examiner*—Neil Abrams
*Assistant Examiner*—Jean F. Duverne
*Attorney, Agent, or Firm*—Scott M. Garrett

[57] ABSTRACT

An accessory connector assembly comprises a connector housing (102, 104), an electrical connector (106) and a circuit substrate mounted horizontally within the connector housing, and an actuator (110). The electrical connector has a cantilevered latch member (124) which is used to engage a latch feature (504) of an accessory port (502) on a communication device (500). The electrical connector is connected to the circuit substrate, upon which circuit components (136) are disposed. The circuit substrate is connectable with an external cable (506). To release the accessory connector assembly from the communication device, the actuator is pressed downwards. Vertical cantilevered actuator arms are urged inwards against the cantilevered latch members to disengage them from the communication device.

16 Claims, 5 Drawing Sheets

ACCESSORY CONNECTOR ASSEMBLY

TECHNICAL FIELD

This invention relates in general to accessories for portable hand held radio communications devices, and in particular accessory connector assemblies for portable hand held radio communication devices.

BACKGROUND

Portable hand held radio communication devices are in widespread use, and are utilized for a variety of communication services such as cellular telephone interconnect and dispatch service. These devices are capable of performing the desired communications activity, but often some users of the devices have a need to extend the capabilities of the communication device. For example, a user may desire to connect an external speaker and/or microphone such as a headset, or the user may desire to use the communication device as a wireless modem. Since the needs of users varies substantially, it would not be beneficial to include the functionality for such additional uses in the device itself; this would make the device too costly and too large. Rather, accessories are designed to couple with the communication device to provide the desired functionality. The use of accessories provides the general user with the smallest, lowest priced communication device, and the ability to select only those accessories necessary to provide any desired additional functionality. Unfortunately, many accessories are designed as afterthoughts by non-original equipment manufacturers, and are awkward, bulky, and difficult to use. Frequently accessories require the manipulation of multiple latches, buttons, and so on. Therefore, there is a need for an accessory connector that is easy to use, and provides the additional functionality desired by the user.

DETAILED DESCRIPTION OF THE PREFERRED EMBODIMENT

Figure 1:
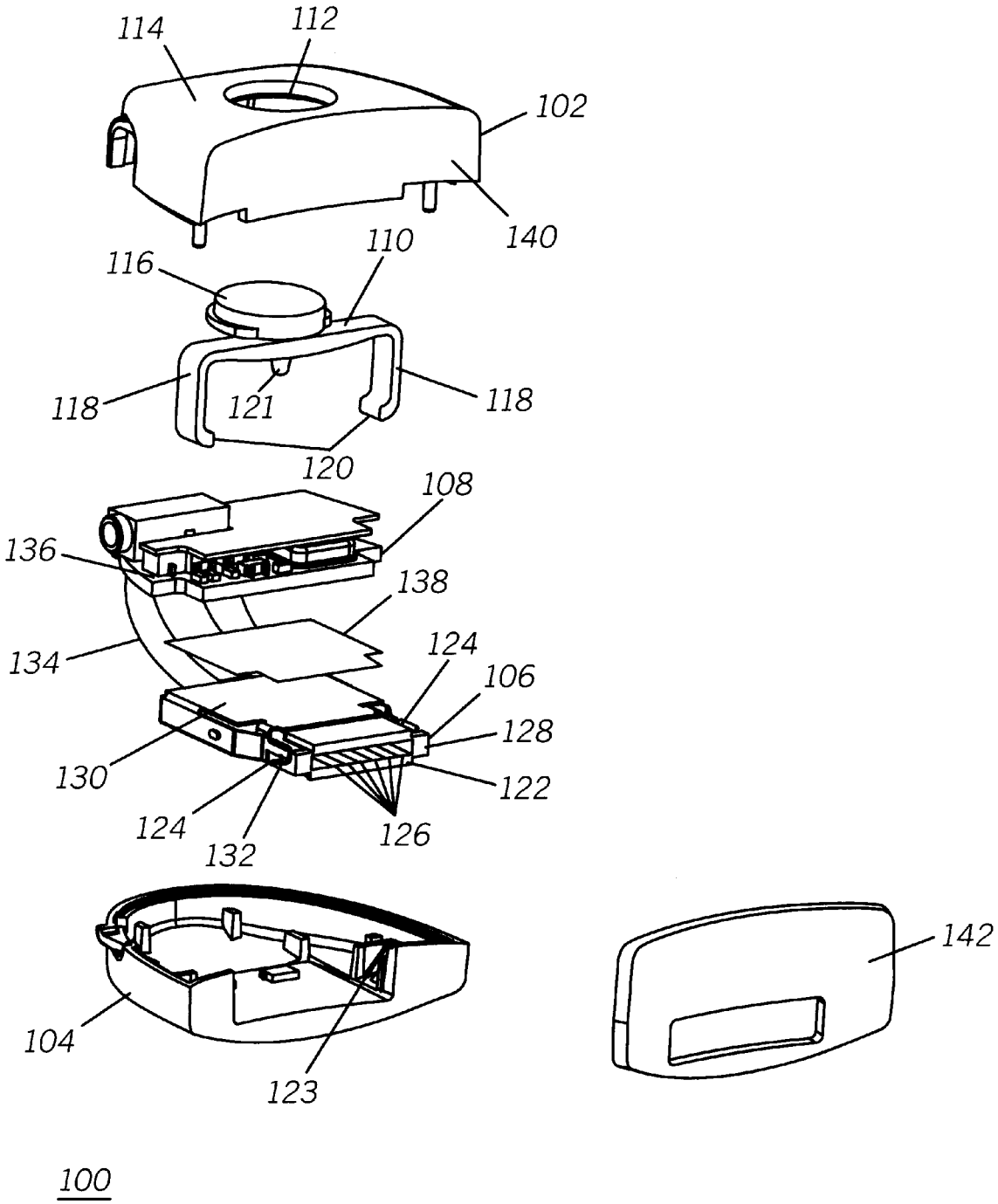
FIG. 1 shows an exploded view of an accessory connector assembly in accordance with the invention.

While the specification concludes with claims defining the features of the invention that are regarded as novel, it is believed that the invention will be better understood from a consideration of the following description in conjunction with the drawing figures, in which like reference numerals are carried forward.

Referring now to FIG. 1, there is shown an exploded view of an accessory connector assembly 100 in accordance with the invention. The assembly comprises a connector housing, which may be provided as a first housing portion 102 and a second housing portion 104, and further comprises an electrical connector 106, a circuit substrate 108, and an actuator 110. The first and second housing portions are fabricated of non electrical conducting material, and joined together by conventional means, such as ultrasonic welding. The connector housing has a top surface 114 with an aperture 112 formed therethrough. The actuator 110 is fabricated of a resilient material, and preferably has a button portion 116 that, upon assembly extends into the aperture 112. The actuator may be provided without the button, but some means for moving the actuator in a vertical direction must be provided. It is contemplated that a portion of the connector housing, such as a so called diving board portion, as is known in the art, may be provided for this reason. The diving board portion would be positioned over the actuator, and in contact with the actuator such that upon pressing the diving board portion, the actuator moves in a vertical direction. By vertical it is meant substantially perpendicular to the major surfaces of the electrical connector. The actuator further comprises at least one vertical cantilevered actuator arm 118 having a terminal end 120, and a stop 121 to prevent overstress when the actuator button is pressed. The connector housing has a sloping member 123 for urging the terminal end of the vertical cantilevered actuator arm inward when the actuator is moved in a vertical direction, as is the case when the button portion is depressed. The sloping member may be a separate piece, but it is preferred that is an integral feature of the connector housing.

The electrical connector 106 can be a standard PC card type connector, such as that shown in U.S. Pat. No. 5,545,052 to Hirai, the disclosure of which is hereby incorporated by reference. Furthermore, the electrical connector is mounted in a substantially horizontal orientation in the connector housing by conventional means, and comprises a contact portion 122 and at least one cantilevered latch member 124. The conductor portion comprises conductors for making electrical interconnections with corresponding conductors disposed in an accessory port of the communication device. Preferably there is an arrangement of a plurality of longitudinally elongated conductors 126 disposed in an electrically insulating resinous member 128. The cantilevered latch member(s) is integrally formed from a component of the electrical connector, such as either the resinous member or a metallic shell 130 disposed around the electrical connector, as taught in Hirai. Further, the cantilevered latch member is compliant, and has a hook or catch 132 for engaging a corresponding latch feature disposed in the accessory port of the communication device.

The circuit substrate 108 is electrically connected to the electrical connector 106 by conventional means such as, for example, wires 134 soldered to both the circuit substrate and the electrical connector. The circuit substrate is a substantially flat member mounted in a substantially horizontal orientation in the connector housing by conventional means, and has at least one electric circuit component 136 disposed thereon, such as, for example, a serial data circuit or an audio driver circuit. Also disposed on the circuit substrate is a means for electrically connecting to an external cable, as will be described hereinbelow. In the preferred embodiment, the circuit substrate is a printed circuit board, as is well known in the art. In the preferred embodiment, the circuit substrate and the electrical connector are mounted adjacent to each other to facilitate the electrical connection between them, and where the electrical connector comprises a metallic shell, an insulating member 138 is disposed between the circuit substrate and the electrical connector.

Upon assembling the elements shown, the electrical connector 106 and the circuit substrate 108 are mounted and held in place within the connector housing in a horizontal position. The contact portion 122 of the electrical connector extends beyond a mating surface 140 so that it can mate with the accessory port of the communication device, which is typically recessed in the communication device. Furthermore, a resilient pad 142 may be disposed on the mating surface to account for tolerances in spacing and act as a cushion should any impactive force be applied to the accessory connector.

Figure 2:
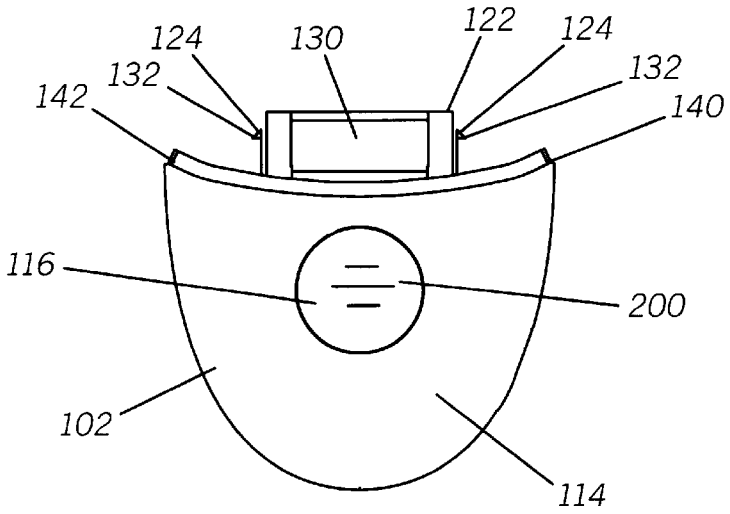
FIG. 2 shows a top plan view of an accessory connector assembly in accordance with the invention.
Figure 3:
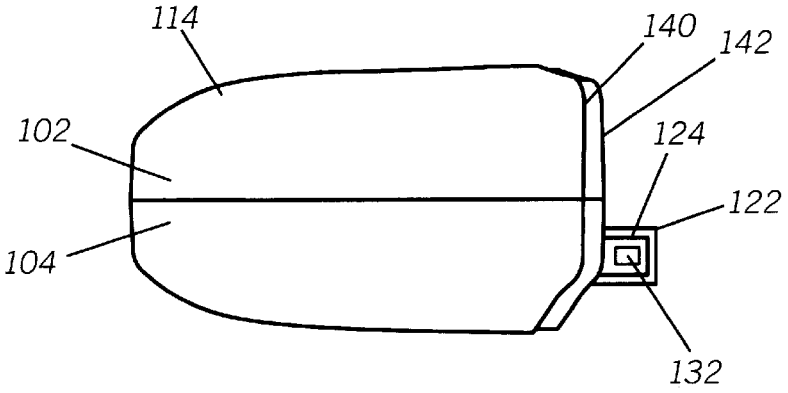
FIG. 3 shows a side elevational view of an accessory connector assembly in accordance with the invention.
Figure 4:
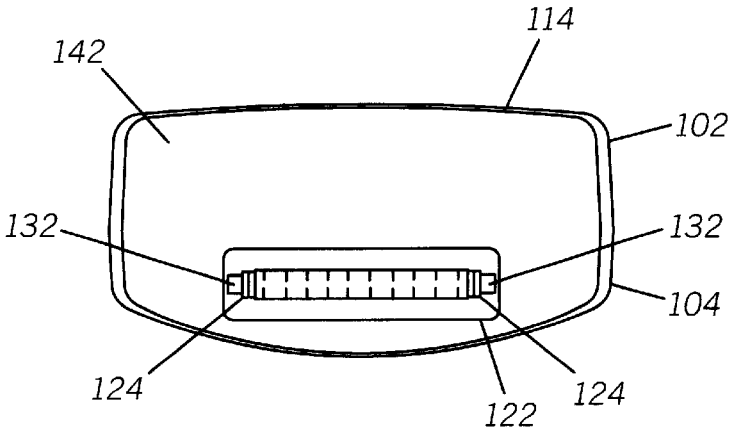
FIG. 4 shows a front elevational view of an accessory connector assembly in accordance with the invention.

In FIGS. 2—3 there is shown an assembled accessory connector in accordance with the invention. In FIG. 2 there is shown a top plan view of an accessory connector in accordance with the invention. It is contemplated that some indicia 200, such as a company trademark or logo, may be disposed on an external surface of the button portion 116. The cantilevered latch member or members 124 can be seen disposed on a side of the contact portion 122. The cantilevered latch member or members are provided such that they are normally spaced apart from the side of the contact, but can be deflected towards the contact portion resiliently. FIG. 3 shows a side elevational view of an accessory connector in accordance with the invention. The contact portion 122 can be seen extending beyond the mating surface 140. Furthermore, the cantilevered latch member or members 124 can be seen, as can the catch 132 disposed on the latch member. FIG. 4 shows a front elevational view of an accessory connector in accordance with the invention. Here the contacts disposed within the contact portion 122 can be seen. Further, it can be seen that in the preferred embodiment, the resilient pad 142 substantially covers the mating surface.

Figure 5:
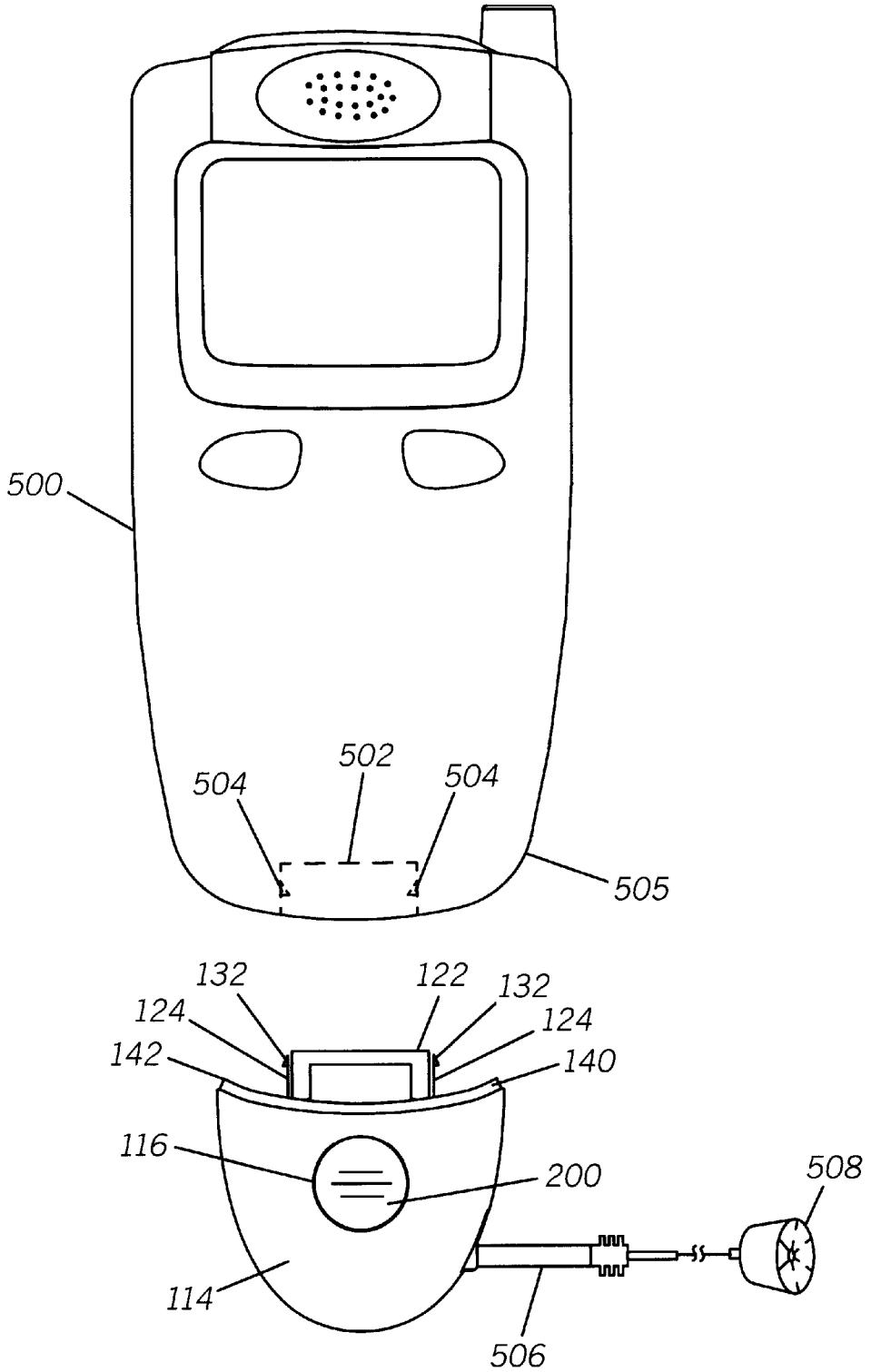
FIG. 5 shows a top plan view of a hand held communications device and an associated accessory connector assembly in accordance with the invention.

FIG. 5 shows a top plan view of a hand held communications device 500 and an associated accessory connector assembly in accordance with the invention. The accessory port 502 is hidden in this particular view, and may be a typical electrical connector in accordance with the known prior art. The accessory port comprises latch features 504 corresponding to the catch 132 on each of the cantilevered latch members 124. The contact portion 122 is inserted into the accessory port to make electrical contact between contacts in the contact portion and contacts in the accessory port thereby coupling the circuit in the assembly connector assembly to the circuitry disposed in the communications device. It can be seen that where, on the communication device, the accessory port is disposed, the surface 505 of the communication device has a contour. It is preferable that the mating surface 140 has a matching contour, and accordingly, so will the resilient pad 142. A primary function of the accessory connector assembly is to contain a circuit and connect to an external cable 506 for coupling the accessory connector assembly with a device, such as an audio speaker 508, for example.

Figure 6:
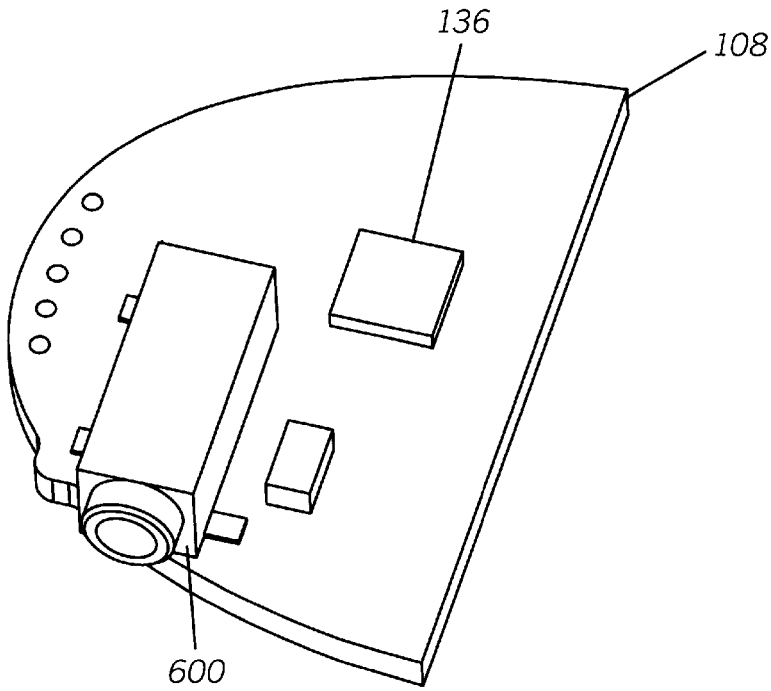
FIG. 6 shows a detail of a first alternative circuit substrate for an accessory connector assembly in accordance with the invention.

FIG. 6 shows a detail of a first alternative circuit substrate 108 for an accessory connector assembly in accordance with the invention. In particular, the means for connecting to an external cable is shown as a plug 600, more commonly referred to as a jack. The jack is suitable for connecting to an audio device, such as a headset comprising a microphone and an earpiece, as is known in the art. The circuit substrate has electrical components 136 disposed thereon, which may be, for example, resistors, transistors, integrated circuits, and so on.

Figure 7:
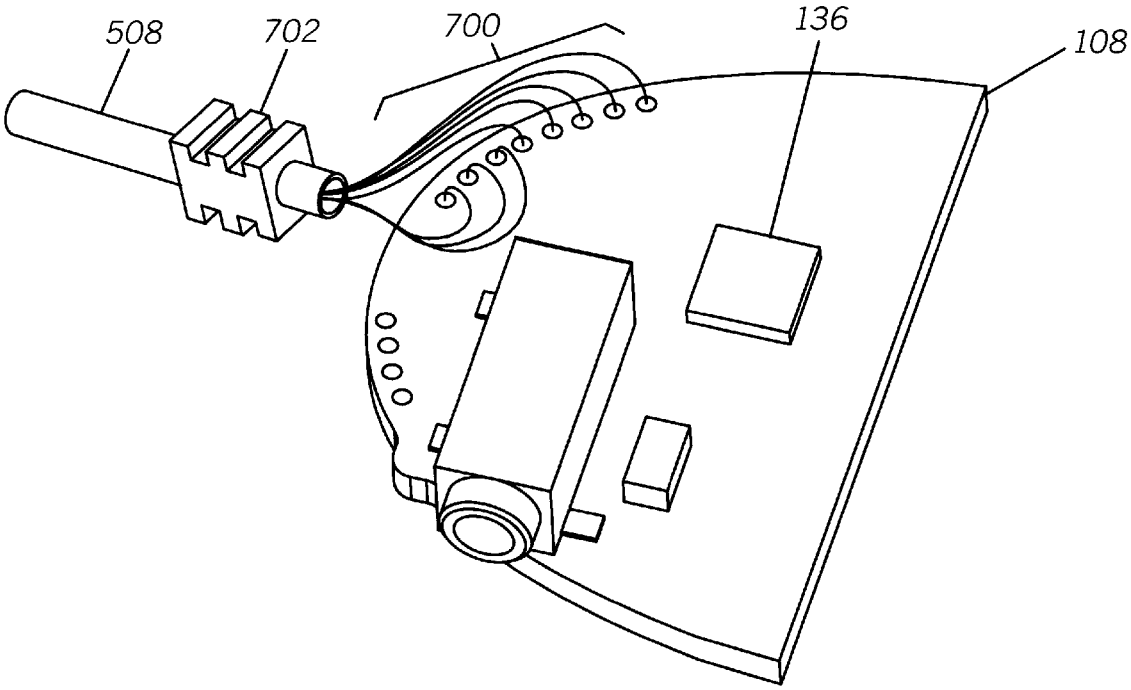
FIG. 7 shows a detail of a second alternative circuit substrate for an accessory connector assembly in accordance with the invention.

FIG. 7 shows a detail of a second alternative circuit substrate for an accessory connector assembly in accordance with the invention, wherein the means for connecting to an external cable is a plurality of vias (plated through holes) formed in a portion of the circuit substrate and electrically connected to the circuit disposed on the circuit substrate. Wires 700 from the cable 508 are separated and soldered into the vias, thereby connecting the cable to the electric circuit. As is common in the art, a strain relief feature 702 is provided on the cable, part of which is typically captured by the connector housing to retain the cable.

Figure 8:
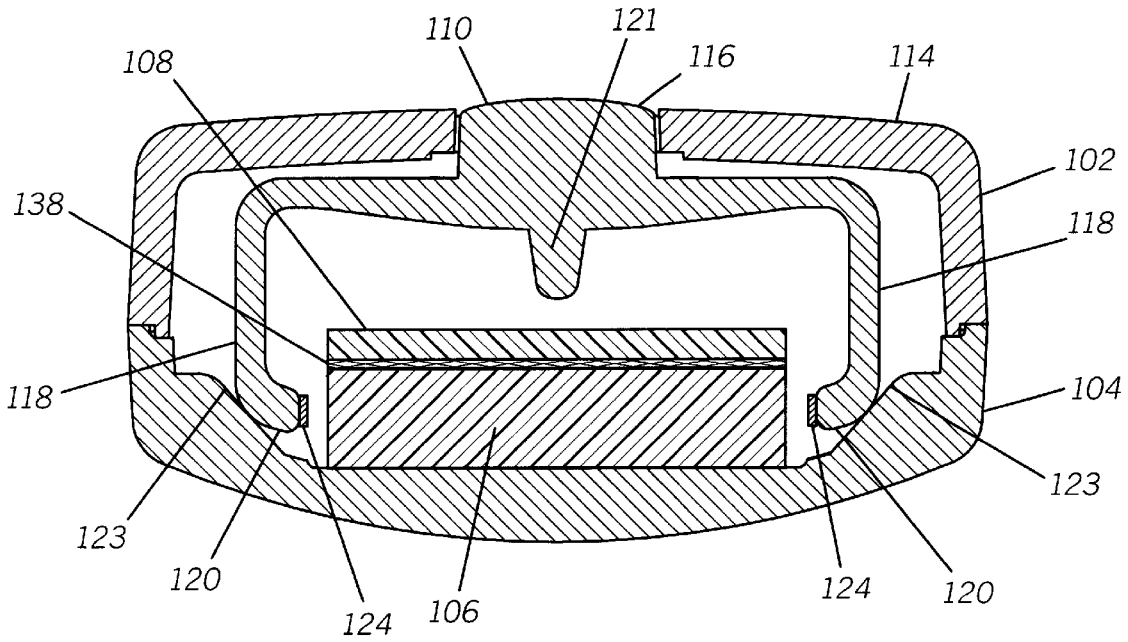
FIG. 8 shows a cross sectional view of an accessory connector assembly with the actuator undepressed, in accordance with the invention.
Figure 9:
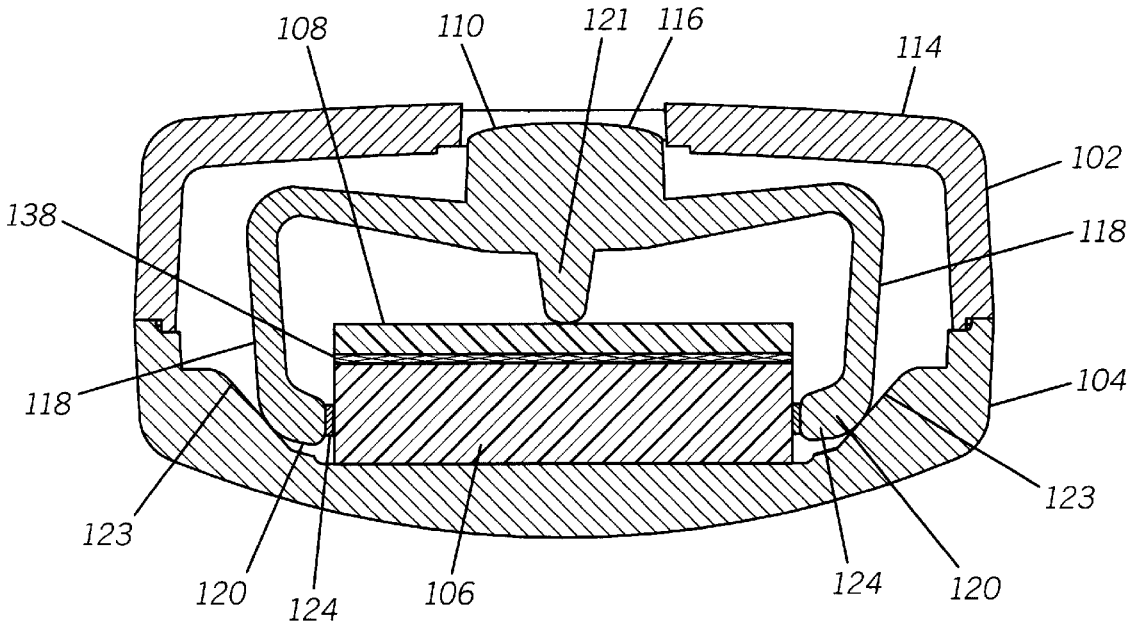
FIG. 9 shows a cross sectional view of an accessory connector assembly with the actuator depressed, in accordance with the invention.

FIGS. 8 and 9 show a cross sectional view of an accessory connector assembly in accordance with the invention. Here, the operation of the actuator and the cantilevered latch members is illustrated. In FIG. 8, the actuator is in an undepressed position. The terminal end 120 of each vertical cantilevered actuator arm 118 is in communication with a corresponding cantilevered latch member 124. By that it is meant that the terminal end of the vertical cantilevered actuator arm is in close proximity, and preferably in contact with its corresponding cantilevered latch member. Preferably, the terminal end of each vertical cantilevered actuator arm bears slightly against the corresponding cantilevered latch member to prevent movement of the actuator, which can result in the actuator producing rattling noises when the accessory connector assembly is in use. Each vertical cantilevered actuator arm 118 bears upon the sloping member 123. FIG. 9 shows the actuator in a depressed position. Each vertical cantilevered actuator arm is pushed downwards against the corresponding sloping member, urging the remote end inwards against the cantilevered latch member of the electrical connector 106. The movement must be enough so that the catch on each of the cantilevered latch member disengages the corresponding latch feature in the accessory port of the communication device. The stop 121 prevents the actuator from being pushed too far, and possibly damaging the actuator or the circuit components. In the preferred embodiment, the actuator comprises a transverse portion 900. The button 116 is centered on the transverse portion and a vertical cantilevered actuator arm is disposed at each end of the transverse portion. Furthermore, the transverse portion is thicker than the vertical cantilevered actuator arms to prevent flexure of the transverse portion upon depressing the button.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as defined by the appended claims.

What is claimed is:

1. An accessory connector assembly for a portable radio communication device, the portable radio communication device having an accessory connector port, the accessory connector assembly comprising:

a connector housing having a top surface and a mating surface, the top surface having an aperture formed therethrough;

an electrical connector mounted in a substantially horizontal orientation within the connector housing and having a contact holding portion for mating with the accessory connector port, the contact portion extending beyond the connector housing at the mating surface, the electrical connector further having at least one cantilevered latch member disposed on a side of the electrical connector for engaging a latch feature disposed in the accessory connector port;

a circuit substrate mounted in a substantially horizontal orientation within the connector housing, electrically connected to the electrical connector, and having a means for electrically connecting to an external cable;

at least one electric circuit component disposed on the circuit substrate;

an actuator having a button portion extending into the actuator aperture of the connector housing and at least one vertical cantilevered actuator arm having a terminal end in communication with the at least one cantilevered latch member; and a sloping member disposed in the housing for urging the terminal end of the at least one vertical cantilevered actuator arm against the at least one cantilevered latch member.

2. An accessory connector assembly as defined in claim 1, wherein the accessory port of the portable hand held radio communication device is provided at a contoured surface, the mating surface of the accessory connector has a matching contour.

3. An accessory connector assembly as defined in claim 1, further comprising a compliant pad disposed on the mating surface.

4. An accessory connector assembly as defined in claim 1, further comprising indicia disposed on an external surface of the button portion.

5. An accessory connector assembly as defined in claim 1, wherein the connector housing comprises a first housing portion and a second housing portion, the first and second housing portions joined together and having features for holding the electrical connector and circuit substrate.

6. An accessory connector assembly as defined in claim 5, wherein the first and second housing portions are welded together.

7. An accessory connector assembly as defined in claim 1, further comprising:

a metallic shell disposed around the electrical connector; and an insulating member disposed between the circuit substrate and the metallic shell.

8. An accessory connector assembly as defined in claim 1, wherein the means for electrically connecting to an external cable comprises a plug.

9. An accessory connector assembly as defined in claim 1, wherein the means for electrically connecting to an external cable comprises a plurality of vias for receiving a corresponding plurality of wires.

10. An accessory connector assembly for a portable radio communication device, the portable radio communication device having an accessory connector port, the accessory connector assembly comprising:

a connector housing having a mating surface and at least one sloping member disposed within the connector housing, and having a sloping member disposed in the housing;

an electrical connector mounted in a substantially horizontal orientation within the connector housing and having a contact holding portion for mating with the accessory connector port, the contact portion extending beyond the connector housing at the mating surface, the electrical connector further having at least one cantilevered latch member disposed on a side of the electrical connector for engaging a latch feature disposed in the accessory connector port;

a circuit substrate mounted within the connector housing, electrically connected to the electrical connector, having a means for electrically connecting to an external cable, and at least one electric circuit component disposed on the circuit substrate;

an actuator having at least one vertical cantilevered actuator arm having a terminal end in communication with the at least one cantilevered latch member; and means for moving the actuator in a vertical direction for moving the at least one cantilevered latch member inward.

11. An accessory connector assembly as defined in claim 10, wherein the connector housing comprises a first portion and a second portion joined together.

12. An accessory connector assembly as defined in claim 10, further comprising a compliant pad disposed on the mating surface.

13. An accessory connector assembly as defined in claim 10, further comprising:

a metallic shell disposed around the electrical connector; and an insulating member disposed between the circuit substrate and the metallic shell.

14. An accessory connector assembly as defined in claim 1, wherein the means for electrically connecting to an external cable comprises a plug.

15. An accessory connector as defined in claim 10, wherein the means for moving the actuator comprises a button portion of the actuator extending through an aperture in a top surface of the connector housing.

16. An accessory connector assembly as defined in claim 15, further comprising indicia disposed on an external surface of the button portion.

* * * * *